United States Patent [19]

Leibrock

[11] 4,108,610

[45] Aug. 22, 1978

[54] METHOD OF AND APPARATUS FOR COMPACTING COKING COAL

[75] Inventor: Kurt Leibrock, Fürstenhausen, Fed. Rep. of Germany

[73] Assignee: Saarbergwerke Aktiengesellschaft, Bochum, Fed. Rep. of Germany

[21] Appl. No.: 764,697

[22] Filed: Feb. 1, 1977

[30] Foreign Application Priority Data

Feb. 3, 1976 [DE] Fed. Rep. of Germany ..... 2603954

[51] Int. Cl.[2] ..... C10L 5/00; B30B 11/00

[52] U.S. Cl. ..... 44/10 G; 44/13; 100/209; 100/218

[58] Field of Search ..... 44/2, 11–13, 44/10 E, 10 D, 10 G; 75/42; 100/209, 218, 237

[56] References Cited

U.S. PATENT DOCUMENTS

| | | | |
|---|---|---|---|
| 692,605 | 2/1902 | Bratton | 100/209 UX |
| 1,498,318 | 6/1924 | Bulkeley | 100/237 UX |
| 2,275,398 | 3/1942 | Koppers | 100/218 UX |
| 3,655,316 | 4/1972 | Husges | 100/218 X |

FOREIGN PATENT DOCUMENTS

| | | | |
|---|---|---|---|
| 358,981 | 10/1931 | United Kingdom | 44/10 G |

*Primary Examiner*—Carl Dees

*Attorney, Agent, or Firm*—Michael J. Striker

[57] ABSTRACT

Coking coal is pounded into a compacted cake of substantially uniform density in a pounding box by means of a plurality of punners mounted on carriages which can move to-and-fro lengthwise of the box. The punners are alternately raised and then allowed to drop under the influence of gravity onto the coal in the box. The raising and dropping is so timed that at any time preferably the foot of only one punner per carriage is in contact with the coal in the box, so as to leave as much as possible of the coal surface area exposed.

12 Claims, 2 Drawing Figures

METHOD OF AND APPARATUS FOR COMPACTING COKING COAL

BACKGROUND OF THE INVENTION

This invention relates to a method of and an apparatus for compacting coking coal in a pounding box.

When certain kinds of bituminous coal are to be used for coking, a satisfactory coking process is assured only if the coal is first compacted by pounding it with punners into a kind of cake. This applies in particular to a highly volatile coal.

Compacting of the coal by punners involves introducing the coal in layers outside the coke oven into a pounding box and compacting it therein into a cake which is then pushed into the over chamber. Compaction of the coking coal is effected by the punners; usually, several of these are mounted in punner carriages which can be moved to and fro lengthwise over the pounding box while the feet of the punners pound the coking coal and are then lifted off again, i.e., the punners alternately drop onto and are lifted off the coal.

It has been found that the properties of the coke obtained from pounded coal, particularly the formation of cracks in the coke and its mechanical strength, depend directly upon the density of compaction which is achieved. It is therefore desired to achieve the greatest possible degree of compaction within the shortest possible time throughout the volume of coal in the pounding box, and at the same time to so compact the coal that its density of compaction is uniform throughout the cake. However, the techniques which have been developed for this purpose still leave something to be desired.

SUMMARY OF THE INVENTION

It is therefore an object of the present invention to improve the state of the art with respect to method and apparatus in such a way that high and uniform compaction densities throughout the coal in the box are obtained within the shortest possible time.

To obtain this object, and others which will become apparent hereafter, the present invention provides a method of compacting coking coal in a pounding box with a number of punners mounted in one or more punner carriages that are adapted to be moved to and fro lengthwise of the box. During the to-and-fro movement of the punner carriage, and while more coking coal is being continuously fed into the working path of the punners, each punner pounds the coking coal in the box in such a way that at least the feet of neighboring punners in the same punner carriage make contact with the coal and are lifted off again in timed succession.

This method of operating the punners has the advantage that gas, particularly air, which is pounded out of the coking coal during the compaction thereof can readily escape into the ambient atmosphere and that additional coal can be more easily filled into the box during the pounding process. This is due to the fact that the surface of the coal in the box is covered at any one time by only one or some of the feet of the punners; more particularly, the feet of the punners next to a punner which is in contact with the coal at a given moment, are raised and thus expose the coal surface.

If the punners are allowed to drop on the coking coal by gravity in free fall, as is currently preferred so that they consume energy only when they are being lifted, the proposed cyclic operation of the punners has the further advantage that at any one time energy of motion need be imparted to only one or some of the punners.

The very considerable and uniform compaction density which is thus achieved can be further improved in a sense of obtaining an even greater uniformity, if each punner mounted on a punner carriage advances in the longitudinal direction of the box a distance equal to the width of the foot of the next punner on the same carriage measured in the same direction plus the distance between these two punner feet and the distance between the next punner foot and the next-but-one punner foot in the same carriage. With this feature the compaction density will be high and uniform throughout the coal cake, even if an individual punner should fail to operate due to some breakdown, since the work of the non-functioning punner will then be taken over by the next punner.

To introduce the compaction energy evenly into the coal in the box it is advisable for the feet of the punners to act on the coking coal throughout the entire length of the box in the course of each to-and-fro movement of the punner carriage or carriages. The punner carriages may preferably be coupled to form a mobile assembly which can then be driven by a single common drive means.

The above-mentioned features of the invention can be applied to compacting equipment which, in a conventional manner, comprises independently moving and driven punner carriages and wherein the reversal of the direction of travel of the carriages is effected, e.g., by the carriages mutually bumping into each other or against stops at the ends of the box. However, the operation of the invention is most efficacious if the punner carriages are coupled and associated with a single common drive means. This manner of driving the punner carriages already ensures a considerable degree of compacting uniformity throughout the bulk of the coal in the box, since substantially like amounts of compaction energy are applied to each individual surface portion of the coal layer in the box. In the conventional compacting equipment, comprising independently mobile and driven punner carriages, the latter cover largely uncontrolled different path lengths so that the resultant compaction density of the coking coal is likely to be extremely irregular.

It is also desirable to apply the energy of motion to the punners independently of the drive of the carriages. The independence of the drives of punners and carriages ensures that the process of compaction need not be interrupted when a single punner fails to function.

To carry out the novel method, the invention proposes an apparatus which comprises a pounding box surmounted by a frame supporting a track for carriages carrying punners, and one or more hydraulic ram cylinders for driving the punner carriages. The use of the hydraulic cylinder greatly reduces the noise of reciprocating the carriages. However, alternatively, the carriages could, e.g., also be driven by one or more endless travelling chains.

If compaction is effected by free-dropping gravity punners, it is convenient to associate each punner with a pair of eccentric rotary lifting cams yieldingly mounted to engage each punner from opposite sides. The lifting cams on the same side of the punner carriage are then mounted on a common shaft at consecutive angles of about $(360°/n)$, where $n$ is the number of punners in the carriage. This disposition of the lifting cams permits the desired consecutive lowering and lifting of neighboring punners to be conveniently effected by simple means.

In a currently preferred embodiment of the apparatus, two or more punner carriages each carrying three or more punners will be provided.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figures 1, 2:
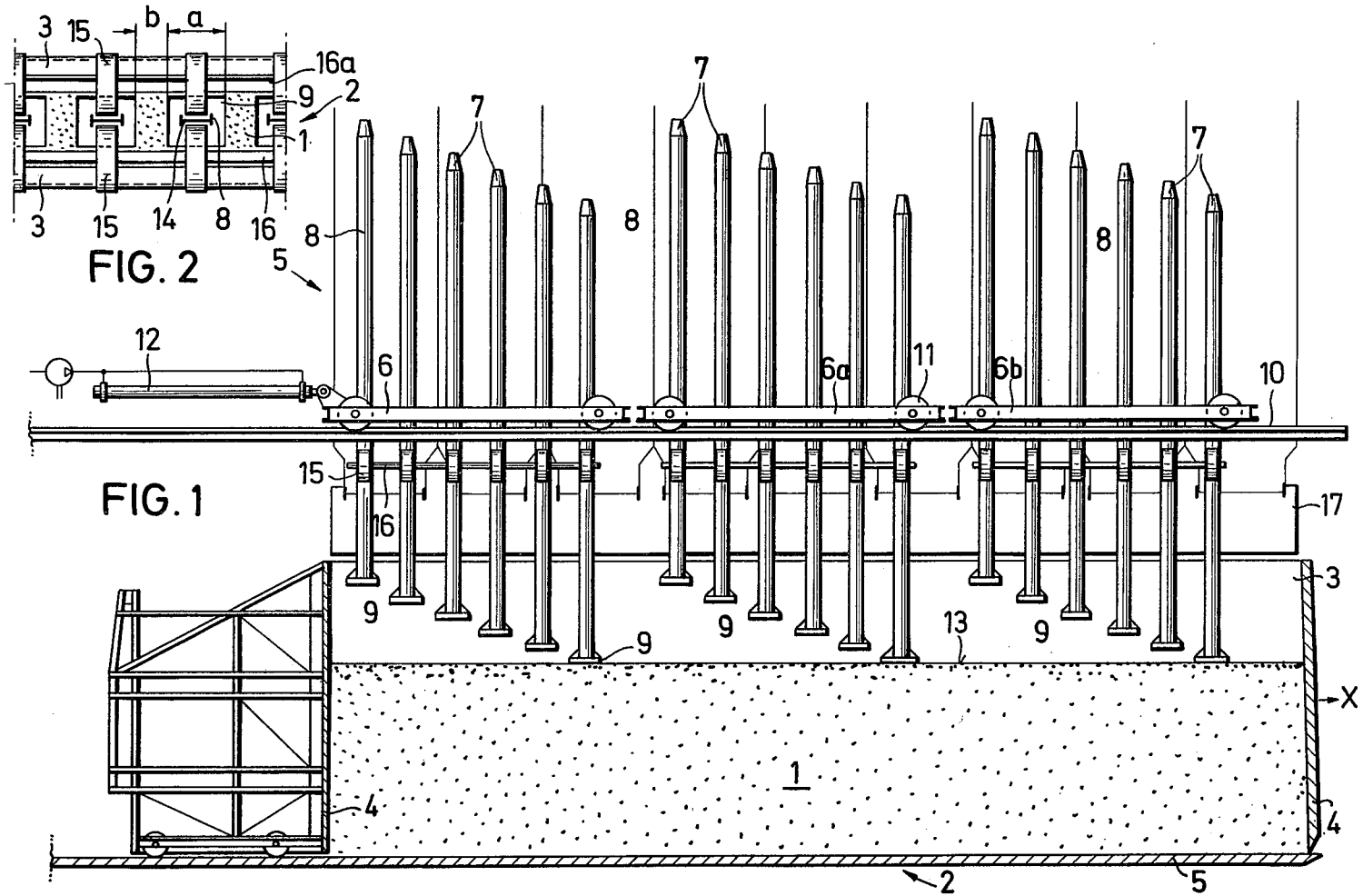
FIG. 1 is a fragmentary sectional side elevation of a pounding box and pounding equipment, according to the invention.
FIG. 2 is a horizontal cross-section of part of a punner carriage.

FIG. 1 shows a pounding box 2 which is nearly completely filled with coking coal 1. The pounding box 2 is open at its top and has vertical side walls 3, end walls 4, and a bottom wall 5. The bottom wall 5 and the end walls 4 are longitudinally movable towards the coke oven chamber (not shown) in the direction indicated by the arrow X; the side walls 3 are fixed and not movable.

Pounding equipment 25 is mounted above the pounding box 2 in a supporting frame (not shown). The pounding equipment 25 comprises three punner carriages 6, 6*a* and 6*b* which together form a mobile assembly. Each punner carriage 6, 6*a* or 6*b* carries six geometrically identical punners 7 each composed of an H-section punner rod 8 and a punner foot 9. The punner feet 9 are equally spaced from one another by a distance *b* and can each be raised and lowered.

The punner carriages 6, 6*a*, and 6*b* have wheels 11 so that they can be pushed to and fro by a hydraulic ram cylinder 12 on a track consisting of two rails 10 extending along the length of the pounding box 2. The travelling distance of the punner carriages is so chosen that in the course of each to-and-fro movement each carriage moves by a distance equal to the width of a punner foot 9 as measured in the lengthwise direction of the pounding box 2 plus twice the distance *b* between neighboring punner feet 9 in the same carriage, again as meaasured in the lengthwise direction of the pounding box 2. During this travel, the punner feet 9 of all three punner carriages will make contact with the entire exposed surface 13 of the coking coal 1 over the entire length of the pounding box 2 in the course of each to-and-fro movement.

During the movement of the mobile assembly the feet 9 of the punners 7 in each punner carriage 6, 6*a* and 6*b* press down in cyclic succession on the exposed surface 13 of the coal 1 for compacting the same, and they are then lifted again, so that at any particular time only one of the six punners 7 in a carriage will be in contact with the coking coal, as illustrated in FIG. 1. The punners 7 drop by gravity in free fall. Each punner 7 is lifted, as shown in FIG. 2, by two lifting cams 15 which frictionally engage each side of the punner web 14 at the same level and which are yieldingly mounted in relation thereto. The cams 15 on one side of each punner carriage 6, 6*a* and 6*b* for engaging the punners 7 in that carriage, are affixed to a common shaft 16 at consecutive angular intervals of 60°. The cams 15 on the other side of the carriages 6, 6*a* and 6*b* are similarly affixed to a common shaft 16*a*. The two shafts 16 and 16*a* of each punner carriage 6, 6*a* and 6*b* are driven by an electric motor or other prime mover, so that the punners 7 are lifted and allowed to drop independently of the reciprocation of the punner carriages 6, 6*a*, 6*b*.

It will be understood that each of the elements described above, or two or more together, may also find a useful application in other types of methods and apparatuses for compacting coking coal differing from the types described above.

While the invention has been illustrated and described as embodied in the pounding of coking coal, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a method of forming a compact coking coal body to be charged into a coking oven in an elongated pounding box with a plurality of punners having respective feet and mounted adjacent each other in at least one punner carriage adapted to be reciprocated lengthwise of the pounding box, the steps of continuously feeding a predetermined amount of coking coal into the pounding box for the coking coal to establish an upper surface therein; raising and lowering the adjacent punners in the same punner carriage in a timed alternate succession at least during said feeding step; and so reciprocating the punner carriage during said raising and lowering step that the feet of the punners contact the upper surface of the coking coal over respective contact regions which overlap each other at least to an extent sufficient for two of the punners of the same punner carriage to substitute for the punner situated therebetween in the event of malfunction of the latter.

2. A method as defined in claim 1, wherein the punners drop onto the coking coal in free fall under the influence of gravity.

3. A method as defined in claim 1, wherein each punner in the punner carriage moves during the reciprocation of the carriage by a distance at least equal to the width of the punner foot of the next punner of the same carriage measured in the lengthwise direction of the pounding box plus the distance between the aforesaid two punner feet and the distance between the feet of the next punner and the next but one punner of the same carriage.

4. A method as defined in claim 1, wherein the punner feet pound the coking coal throughout the length of the box during each to and fro movement of the carriage.

5. A method as defined in claim 1, wherein a plurality of punner carriages are provided and are coupled to form a mobile assembly which can be operated by a common drive means.

6. A method as defined in claim 1, comprising the step of supplying energy of motion to the punners independently of the drive means of the associated punner carriage.

7. Apparatus for forming a compact coking coal body to be charged into a coking oven, comprising an elongated pounding box; at least one punner carriage mounted for reciprocation longitudinally of said pounding box; a plurality of punners mounted on said punner carriage for reciprocation therewith and for movement relative thereto along substantially vertical paths and having respective feet; means for moving said punners relative to said punner carriage at least while a predetermined amount of the coking coal is being continuously fed into said pounding box to establish an upper surface therein; and means for so simultaneously reciprocating said punner carriage that said feed of said punners contact the upper surface of the coking coal over respective contact regions which overlap each other to an extent sufficient for two of said punners to substitute for the punner situated therebetween in the event of malfunction of the latter.

8. Apparatus as defined in claim 7, wherein said drive means for the punner carriages comprise a least one endless travelling chain.

9. Apparatus as defined in claim 7, wherein said drive means comprise at least one hydraulic ram cylinder.

10. Apparatus as defined in claim 7; further comprising a pair of eccentric rotary lifting cams yieldingly mounted to engage each of said punners from opposite sides thereof.

11. Apparatus as defined in claim 10, wherein the lifting cams on one side of the punner carriage are mounted consecutively on a common shaft at angles differing by about $360°/n$, wherein $n$ is the number of punners in the carriage.

12. Apparatus as defined in claim 7, comprising at least one additional punner carriage similar to said one punner carriage; and wherein said punner carriages are each equipped with at least three of said punners.

* * * * *

UNITED STATES PATENT AND TRADEMARK OFFICE

CERTIFICATE OF CORRECTION

PATENT NO. : 4,108,610

DATED : August 22, 1978

INVENTOR(S) : Kurt Leibrock

It is certified that error appears in the above—identified patent and that said Letters Patent is hereby corrected as shown below:

On the title page,

[73] The address of the assignee should read

-- Saarbruecken, Fed. Rep. of Germany --.

Signed and Sealed this

*Twenty-eighth* Day of *December 1982*

[SEAL]

*Attest:*

GERALD J. MOSSINGHOFF

*Attesting Officer*

*Commissioner of Patents and Trademarks*